US010982852B2

(12) United States Patent
Sauer et al.

(10) Patent No.: US 10,982,852 B2
(45) Date of Patent: Apr. 20, 2021

(54) COWL INTEGRATION TO COMBUSTOR WALL

(71) Applicant: Rolls-Royce Corporation, Indianapolis, IN (US)

(72) Inventors: Kevin Sauer, Plainfield, IN (US); Lewis Dailey, Lebanon, IN (US); Keith McCormick, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 356 days.

(21) Appl. No.: 16/180,388

(22) Filed: Nov. 5, 2018

(65) Prior Publication Data

US 2020/0141578 A1 May 7, 2020

(51) Int. Cl.

| | |
|---|---|
| ***F23R 3/00*** | (2006.01) |
| ***F23R 3/50*** | (2006.01) |
| ***F23R 3/04*** | (2006.01) |

(52) U.S. Cl.

CPC ..... *F23R 3/002* (2013.01); *F23R 3/04* (2013.01); *F23R 3/50* (2013.01)

(58) Field of Classification Search

CPC .. F23R 3/002; F23R 3/50; F23R 2900/00018; F23R 3/04; F05D 2230/22

See application file for complete search history.

(56) References Cited

U.S. PATENT DOCUMENTS 3,854,285 A 12/1974 Stenger et al.
4,843,825 A 7/1989 Clark
4,979,361 A 12/1990 Clark et al.
5,181,377 A * 1/1993 Napoli ..... F23R 3/002 60/752
5,237,820 A 8/1993 Kastl et al.
(Continued)

FOREIGN PATENT DOCUMENTS

EP 2 806 217 A2 11/2014
FR 2 909 163 A1 5/2008
(Continued)

OTHER PUBLICATIONS

Arthur H. Lefebvre et al., "Gas Turbine Combustion Alternative Fuels and Emissions", 2010—CRC Press—Taylor & Francis Group, pp. 1-560.

(Continued)

*Primary Examiner* — Katheryn A Malatek
(74) *Attorney, Agent, or Firm* — Brinks Gilson & Lione

(57) ABSTRACT

A combustion section of a gas turbine engine may include a cassette configured to couple to an annular combustor dome arranged around a flow path for the gas turbine engine. The annular combustor dome may include a dome wall comprising a plurality of inlets configured to receive compressed air for a combustion chamber located downstream, relative to the flow path, from the annular combustor dome. The cassette may include a combustor wall extended away from the dome wall in a downstream direction. The cassette may further include a cowl integral to the combustor wall. At least a portion of the cowl may extend away from the dome wall in an upstream direction relative to the flow path. The cowl may receive compressed air from a diffusor and guide the compressed air to a space upstream from the inlets, relative to the flow path.

19 Claims, 8 Drawing Sheets

(56) References Cited

U.S. PATENT DOCUMENTS

| | | | | |
|---|---|---|---|---|
| 5,279,126 | A | 1/1994 | Holladay | |
| 5,285,630 | A | 2/1994 | Ansart et al. | |
| 5,331,815 | A | 7/1994 | Reinhold, Jr. et al. | |
| 5,924,288 | A * | 7/1999 | Fortuna | F23R 3/002 60/752 |
| 6,449,952 | B1 | 9/2002 | Emilianowicz et al. | |
| 6,672,067 | B2 | 1/2004 | Farmer et al. | |
| 8,661,829 | B2 | 3/2014 | Bourgois et al. | |
| 9,127,841 | B2 | 9/2015 | Bourgois et al. | |
| 10,619,856 | B2 | 4/2020 | McCormick et al. | |
| 2008/0098737 | A1 | 5/2008 | Haggerty et al. | |
| 2015/0260409 | A1 * | 9/2015 | Clemen | F23R 3/283 60/798 |
| 2015/0285498 | A1 | 10/2015 | Cunha et al. | |
| 2016/0108814 | A1 | 4/2016 | Schmitz | |
| 2017/0016620 | A1 | 1/2017 | Masquelet et al. | |
| 2017/0307221 | A1 * | 10/2017 | Hucker | F23R 3/46 |
| 2018/0259186 | A1 | 9/2018 | McCormick et al. | |
| 2019/0093893 | A1 | 3/2019 | Clemen et al. | |

FOREIGN PATENT DOCUMENTS

| | | | |
|---|---|---|---|
| FR | 2 964 725 | A1 | 3/2012 |
| GB | 694448 | | 7/1953 |
| WO | WO 2010/105999 | A1 | 9/2010 |

OTHER PUBLICATIONS

Extended European Search Report, dated Jul. 27, 2018, pp. 1-6, issued in European Patent Application No. 18157528.3, European Patent Office, The Hague, The Netherlands.

European Office Action, issued in European Patent Application No. 18 157 528.3, dated Jun. 27, 2019, pp. 1-5, European Patent Office, Rijswijk, Netherlands.

* cited by examiner

COWL INTEGRATION TO COMBUSTOR WALL

This invention was made with government support under contract DTFAWA-14-R-73573 awarded by the Federal Aviation Administration. The government has certain rights in the invention.

TECHNICAL FIELD

This disclosure relates to gas turbine engines and, in particular, to gas turbine engine combustors.

BACKGROUND

A gas turbine engine may include a combustor section that receives gas and air for combustion. The flow of the compressed air within the combustor section may influence efficient operation of the gas turbine engine. The combustor section may include various components to guide the flow of compressed air and/or combustion. These components may be exposed to stresses caused by the flow of compressed air, heat generated by combustion, vibration from engine operation, and other stresses.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

By way of an introductory example, the combustor system many include an annular combustor dome arranged around a flow path for a gas turbine engine. The combustor dome may include a first outer surface and a second outer surface radially inward from the first outer surface, relative to the flow path. The annular combustor dome may further include a plurality of inlets in fluid communication with a combustion chamber downstream from the annular combustor dome.

The combustor system may further include a plurality of cassettes positioned on the first outer surface of the dome. At least one of the cassettes may include a cowl integral to a combustor wall. The combustor wall may extend in a downstream direction, relative to the flow path. The combustor wall may at least partially define the combustion chamber. The cowl may extend away from the combustor dome in an upstream direction, relative to the flow path. The cowl may convey fluid received from a diffusor in a radial inward direction to a space upstream of the combustor dome.

One technical advantage of the systems and methods described herein may be that the cowl may be integral to the combustor wall such that the cowl and the combustor wall are separate portions of the cassette. Integrating the cowl with the combustor wall may reduce a number of components in the combustor system and/or a number of coupling locations. Reducing the number of components may increase manufacturing time and/or decrease failures resulting from improper installation and defective components. In some examples, integrating the cowl to the combustor wall may result in less material, such as fasteners, welds, or molded sheet metal, resulting in a weight reduction.

Another technical advantage of the systems and methods described below may be that the cassette may include structures that increase the structural integrity of the cassette, optimize flows of compressed air into and around a combustion chamber, and/or provide other efficiencies related to manufacturing and operating a gas turbine engine. The structures may be integral to the cowl, thereby reducing the number of steps and components involved coupling the structures to the cowl. By way of ALM, structures designed to finely tune engine performance and/or improve structural integrity may be integrated in the cassette as a unitary structure. For example, the cassette may include stiffening structures configured to tune the dynamic response of the cowl and/or increase the impact resistance of the cowl. Additional or alternative technical advantages are made evident in the systems and methods described herein.

Figure 1:
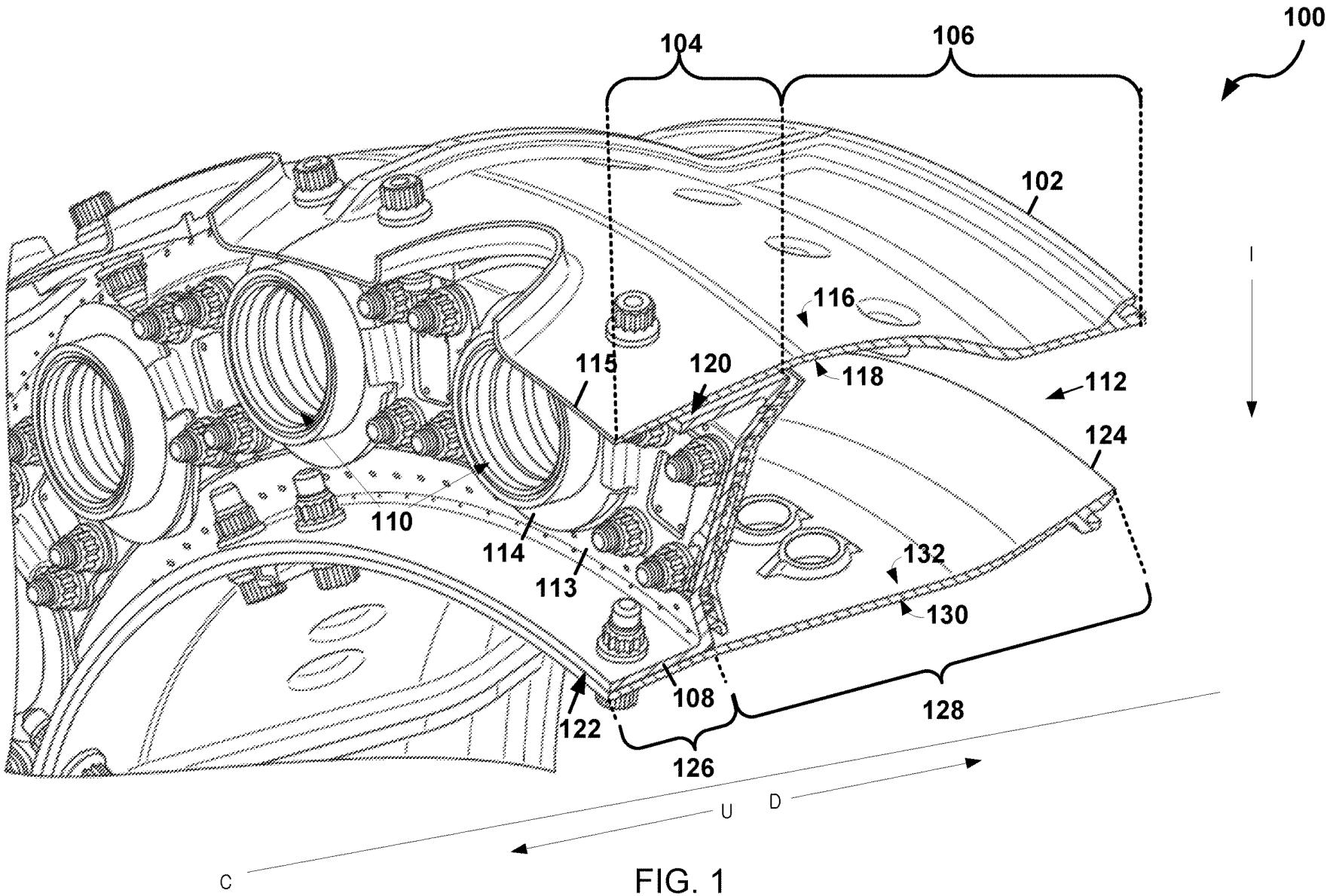
FIG. 1 illustrates a first example of a combustor system.

FIG. 1 illustrates a first example of a combustor system 100. The system 100 may include a cassette 102. The cassette 102 may include a cowl 104 and a combustor wall 106. The cowl 104 may be integral to the combustor wall 106. For example, the cassette 102 may include a unitary structure in which the cowl 104 and the combustor wall 106 are separate portions of the cassette 102.

As described herein, a first component is integral to a second component when the first component and the second component are each a separate portions of a unitary structure. In the examples described herein, the cassette 102 may be a unitary structure. The cowl 104 and the combustor wall 106 may be separate respective portions of the cassette 102. The cowl 104 may be interchangeably referred to as a cowl portion of the cassette 102. The combustor wall 106 may be interchangeably referred to as a combustor wall portion of the cassette 102. The cassette 102 may be formed without attaching a separate cowl with a separate combustor wall. In some examples, the cassette 102 may be formed by Additive Layer Manufacturing (ALM).

ALM may include a manufacturing technique in which a three dimensional component is formed by successively solidifying new layers of material on top of previous layers of solidified material. For example, ALM may include powder bed fusion. Powder bed fusion may include a type of ALM in which an energy beam such as a laser or electron beam heats portions of a bed of powder. The heated powder is fused into place to form a solid layer. The three-dimensional component is formed by repeatedly heating and fusing additional layers of power on top of previously fused layers.

The cassette 102 may be formed through ALM by successively solidifying new layers of material on top of previous layers of solidified material. For example, the cassette 102 may formed by way of powder bed fusion. Powder may be added on top of a previously solidified layer of the cassette 102. Additional layers may be added to the cassette 102 be heating the power with an energy beam. At least one of the layers solidified by the energy beam may include a portion of the cowl 104 and a portion of the combustor wall 106. The energy beam may include a laser or an electron beam.

Figure 7:
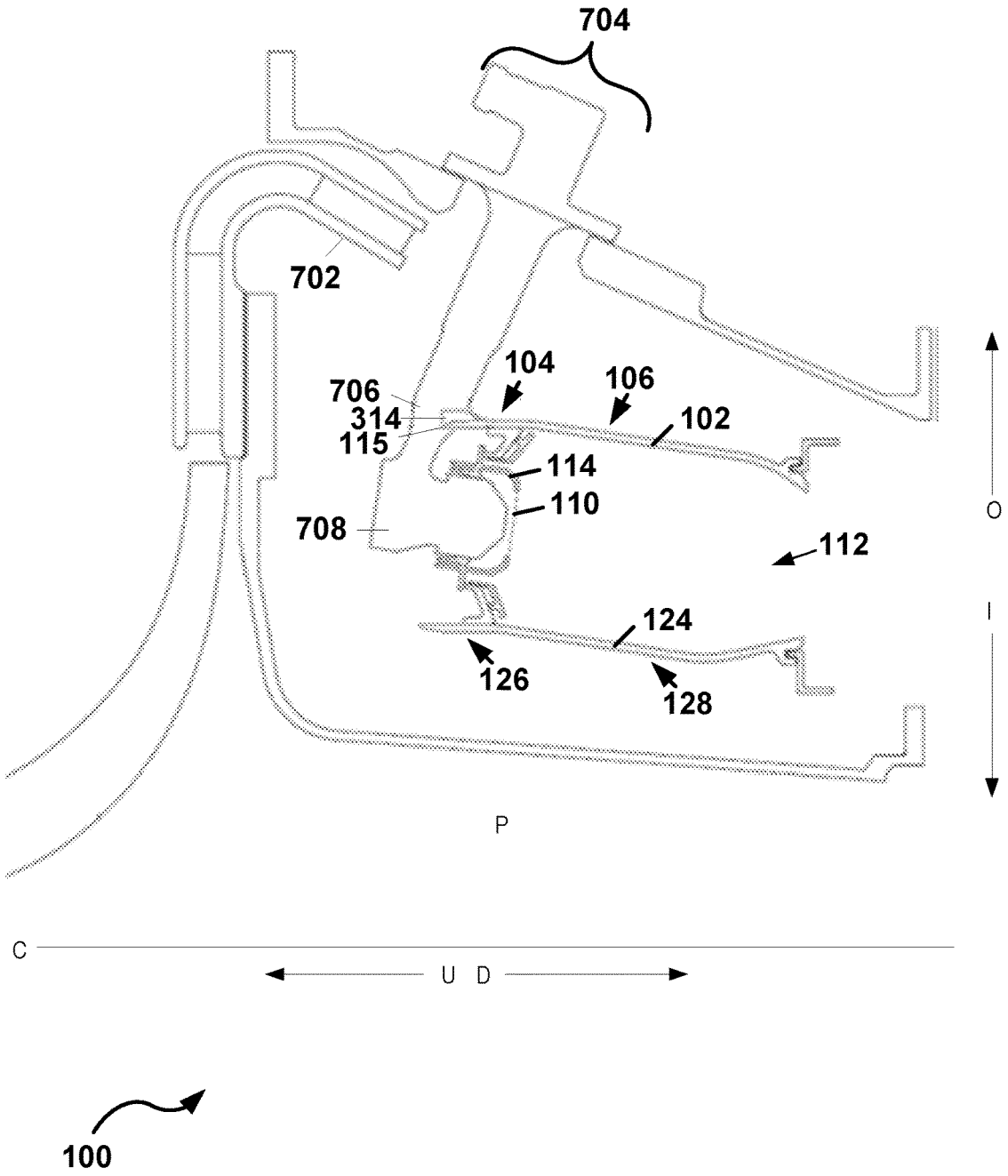
FIG. 7 illustrates a third example of a combustion system.

The system 100 may further include a combustor dome 108. The combustor dome may be arranged around a centerline C for a gas turbine engine. The centerline C may extend through a cross section defined by the combustor dome 108. The combustor dome 108 may include a plurality of inlets 110. The inlets 110 may fluidly communicate with a combustion chamber 112 downstream from the combustor dome 108. For example, the inlets 110 may receive air from a diffusor and convey the air to the combustion chamber 112 (a diffusor is shown in FIG. 7). Alternatively or in addition, the inlets 110 may receive fuel, air, and/or an air/fuel mixture from a fuel injector (a fuel injector is shown in FIG. 7). In some examples, the combustor dome 108 may include a swirler 114, or multiple swirlers. The swirler 114 may define the at least one of the inlets 110. The swirler 114 may mix air and fuel for combustion in the combustion chamber 112. The swirler 114 may convey the air and fuel along a downstream direction D.

The combustor dome 108 includes a dome wall 113. The dome wall 113 may at least partially define the combustion chamber 112. Alternatively or in addition, the dome wall 113 may separate the combustion chamber 112 from a compressor discharge cavity upstream from the combustion chamber 112. In some examples, the dome wall 113 may extend the distance between a first outer surface 120 and a second outer surface 122, which at least in part face each other. The first outer surface 120 may be positioned radially outward from the second outer surface 122, relative to the centerline C and/or a flow path for a gas turbine engine that extends along the centerline C. In some examples, the dome wall 113 may define the inlets 110. Alternatively or in addition, the dome wall 113 may include swirlers that respectively define the inlets 110

The cowl 104 may extend along an upstream direction U away from the combustor wall 106, the combustion chamber 112 and/or the dome wall 113. The cowl 104 may influence a pressure and/or a velocity of air flowing to the inlets 110. For example, the cowl 104 may redirect air from a diffusor to flow along an outer surface 116 of the cassette 102 along the upstream direction U. Alternatively or in addition, the air may flow along a radially inward direction I, relative to the centerline C. After reaching an edge 115 of the cowl 104, the air may flow back along the upstream direction U and into the combustion chamber 112.

The combustor wall 106 of the cassette 102 may at least partially define the combustion chamber 112. The combustor wall 106 may extend along a downstream direction D away from the dome wall 113 and/or the cowl 104. The combustor wall 106 may include a portion of the cassette 102 that is downstream from the combustor dome 108. An inner surface 118 of the cassette 102 along the combustor wall 106 may be a liner for the combustion chamber 112.

The combustor dome 108 may receive the cassette 102. For example, the cassette 102 may couple to the combustor dome 108. In some examples, the cassette 102 may fasten to the combustor dome 108 by way of one or more fasteners. Alternatively or in addition, the cassette 102 may couple to the combustor dome 108 by way of welding, brazing, or some other attachment. In some examples, the first outer surface 120 may receive the inner surface 118 of the cassette 102. For example, a fastener may extend through the outer surface 116 of the cassette 102, the inner surface 118 of the cassette 102, and/or the first outer surface 120 to couple the cassette 102 to the combustor dome 108.

Coupling the cassette 102 to the combustor dome 108 may support the combustor wall 106 and the cowl 104. For example, the cowl 104 and the combustor wall 106 may be separate portions of the cassette 102. In some examples, only the cowl 104 may be coupled to the combustor dome 108 by of way of a fastener or melted joint, such as weld or braising joint. The fastener and/or joint may couple the cowl 104 and the combustor wall 106 to the combustor dome 108. In some examples, the combustor wall 106 may not contact the combustor dome 108. Alternatively or in addition, the combustor wall 106 may not be affixed to the combustor dome 108 by any fasteners or by a melted joint. In other examples, the cowl 104 may not contact the combustor dome 108 and the combustor wall 106 may couple to the combustor dome 108.

The system 100 may further include an opposing cassette 124. The opposing cassette 124 may be positioned on the combustor dome 108 radially inward from the cassette 102, relative to the centerline C. The opposing cassette 124 may include an opposing cowl 126 and an opposing combustor wall 128. The opposing cowl 126 and the opposing combustor wall 128 may be separate portions of the opposing cassette 124. The opposing cowl 126 may be integral to the opposing combustor wall 128. For example, the opposing cassette 124 may be formed by ALM.

The opposing cowl 126 may extend along the upstream direction U and away from the combustion chamber 112, the opposing combustor wall 128, and/or the dome wall 113. For example, opposing cowl 126 of the cassette 102 may receive air along an outer surface 130 of the opposing cassette 124. The outer surface 130 of the opposing cassette 124 may face the centerline C.

The opposing combustor wall 128 may include portion of the opposing cassette 124 that at least partially defines the combustion chamber 112. For example, the combustion chamber 112 may be defined between the combustor wall 106 and the opposing combustor wall 128.

The opposing cassette 124 may include an inner surface 132. The inner surface 132 of the opposing cassette 124 may at least partially define the combustion chamber 112. For example, the opposing combustor wall 214 may include at least a portion of the inner surface 132 of the opposing cassette 124. The combustion chamber 112 may be defined between the inner surface 118 of the cassette 102 and the inner surface 132 of the opposing cassette 124.

The combustor dome 108 may receive the opposing cassette 124. For example, the second outer surface 122 of the combustor dome 108 may receive the inner surface 132 of the opposing cassette 124. Alternatively or in addition, opposing cassette 124 may couple to the combustor dome 108 by way of one or more fastener. In some examples, a faster may extend through the outer surface 130 of the opposing cassette 124, the inner surface 132 of the opposing cassette 124, and/or the second outer surface 122. Alternatively or in addition, the opposing cassette 124 may be joined with the combustor dome 108 by way of welding, or some other suitable attachment technique.

The combustion chamber 112 may receive a mixture of fuel and air for combustion in a gas turbine engine. The cassette 102, the opposing cassette 124, and/or the dome wall 113 may at partially or completely define the combustion chamber 112. For example, the combustion chamber 112 may be defined between the inner surface 118 of the cassette 102 and the inner surface 132 of the opposing cassette 124.

In some examples, the cowl 104 may extend along the upstream direction U further than the opposing cowl 126. In other examples, the cowl 104 and the opposing cowl 126 may extend a same proximate distance from the dome wall 113. In other examples, the system may include the cowl 104 without the opposing cowl. Alternatively or in addition, the system may include the opposing cowl without the cowl 104. In some examples, the cowl 104 and the opposing cowl may include mirrored features but are oriented on separate outer surfaces of the combustor dome 108, such as the first outer surface 120 and the second outer surface 122.

During manufacturing and assembly, multiple cowls and/or opposing cowls may be formed by way of ALM. The cowls and/or opposing cowls may be positioned around the combustor dome 108.

Figure 2:
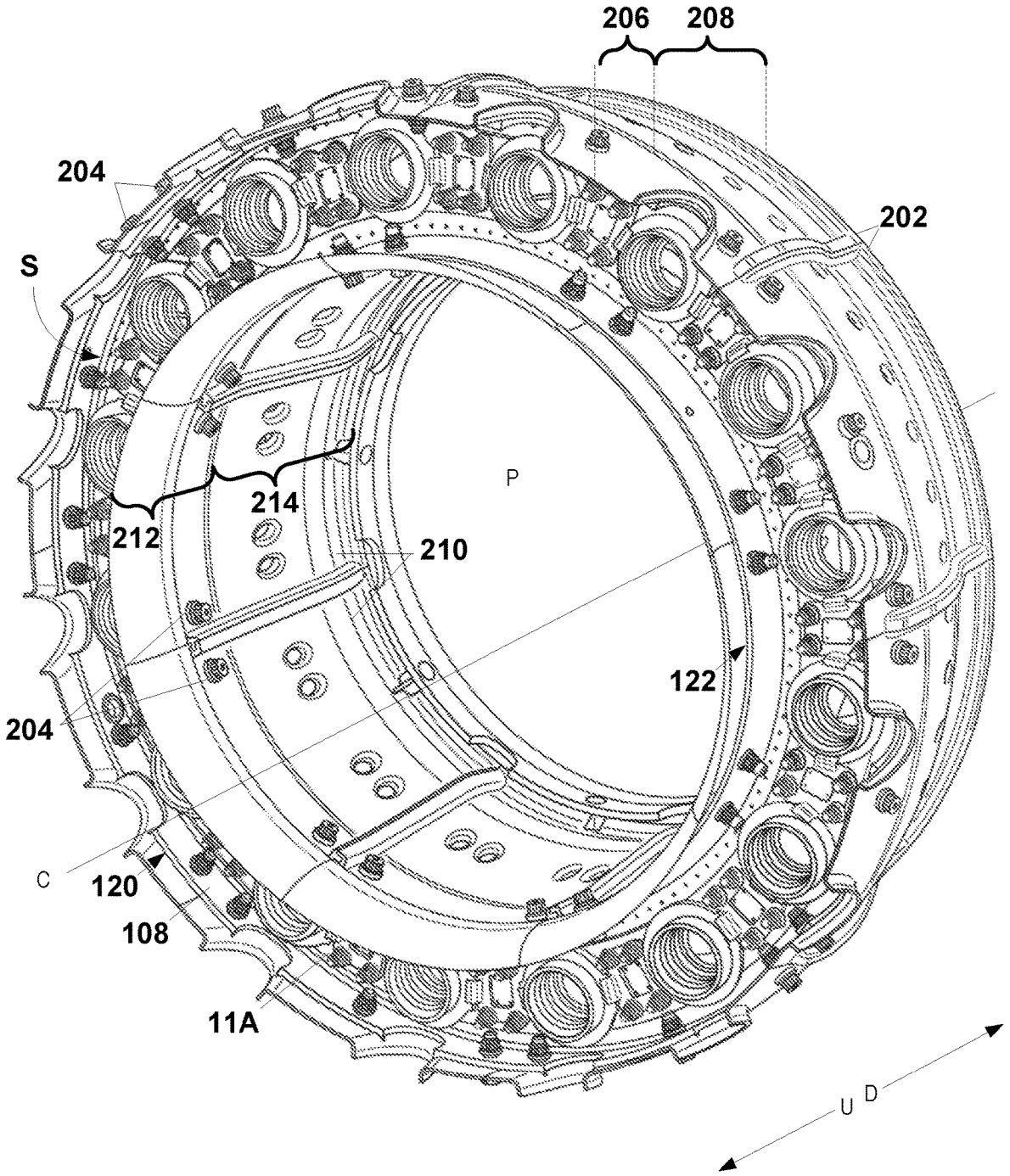
FIG. 2 illustrates a second example of a combustor system.

FIG. 2 illustrates a second example of the combustor system 100. The combustor dome 108 may include an annular or semi-annular structure arranged around the centerline C. Alternatively or in addition, the combustor dome 108 may be arranged around a flow path P for a gas turbine engine. The flow path may include a path in which air flows along the engine centerline. The flow path may extend along the centerline C. The combustor dome 108 may define the flow path. Alternatively or in addition, one or more components positioned radially inward from the combustor dome 108 may define or partially define the flow path.

The system 100 may include a plurality of cassettes 202. Each of the cassettes 202 may include the cassette 102 described in reference to FIG. 1. The cassettes 202 may be positioned on the first outer surface 120. The cassettes 202 may mount to the first outer surface 120 by way of one or more fasteners 204. For example, the fasteners 204 may extend through the cassettes 202 and the first outer surface 120. In other examples, the cassettes 202 may be joined to the first outer surface 120 by way of welding, or some other attachment technique.

The cowls of the cassettes 202 may join together to define an annular cowl 206 around a first side of the combustor dome 108. The annular cowl 206 may extend away from the dome wall 113 along the upstream direction U. Alternatively or in addition, the annular cowl 206 may tapper radially inward toward a centerline C of the gas turbine engine. For example, the annular cowl 206 may curve radially inward toward the centerline C.

The combustor walls of the cassettes 202 may join together to define a annular combustor wall 208. The annular combustor wall 208 may at least partially define the combustion chamber 112 for the gas turbine engine.

Alternatively or in addition, the system 100 may include a plurality of opposing cassettes 210. Each of the opposing cassettes 210 may include the opposing cassette 124 described in reference to FIG. 1. The opposing cassettes 210 may be positioned on the second outer surface 122 along an inner ring of the combustor dome 108. The opposing cassettes 210 may mount to the second outer surface 122 by way of the fasteners 204. For example, respective stems of the fasteners 204 may extend through the opposing cassettes 210 and the second outer surface 122. In other examples, the opposing cassettes 210 may be joined to the second outer surface 122 by way of welding, or some other attachment technique.

The cowls of the opposing cassettes 210 may join together to define an opposing annular cowl 212 around the first side of the combustor dome 108. The opposing annular cowl 212 may extend away from the combustor dome wall 113 along the upstream direction U. Alternatively or in addition, the opposing annular cowl 212 may tapper radially outward and away a centerline C of the gas turbine engine. For example, the opposing annular cowl 212 may curve radially outward and away from the centerline C.

The combustor walls of the cassettes 302 may join together to define an opposing annular combustor wall 214. The opposing annular combustor wall 214 may at least partially define the combustion chamber 112 for the gas turbine engine. For example, the combustion chamber 112 may be defined between the annular combustor wall 208 and the opposing annular combustor wall 214.

In some examples, a space S may be defined between the annular cowl 206 and the opposing annular cowl 212. The inlets 110 of the combustor dome 108 may receive air conveyed to the space S by annular cowl 206 and/or the opposing annular cowl 212.

Figure 3:
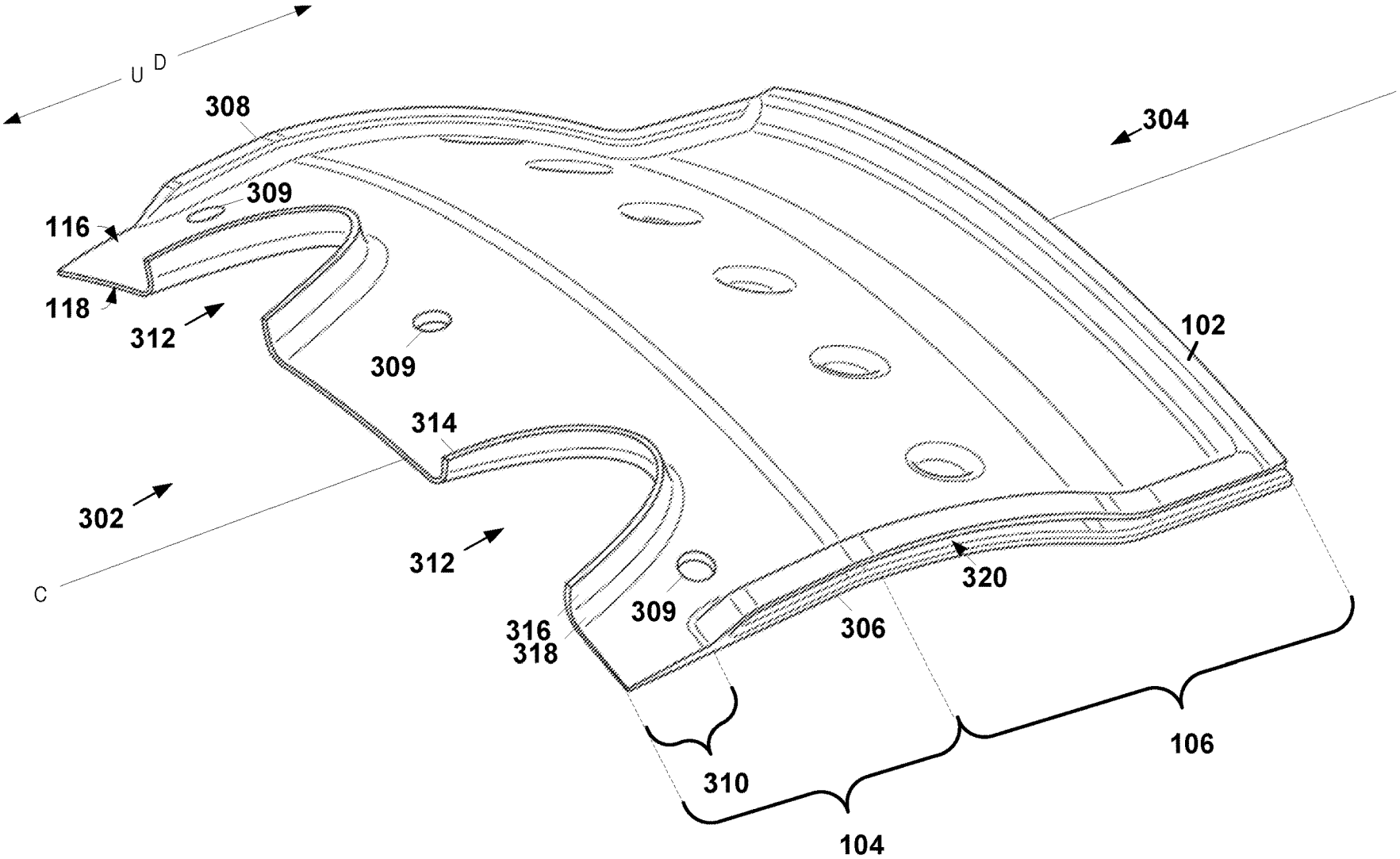
FIG. 3 illustrates an example of a cassette for a combustor system.

FIG. 3 illustrates an example of the cassette 102 for the combustor system 100. The cassette 102 may include a first axial side 302 and a second axial side 304. The cassette 102 may be defined between the first axial side 302 and the second axial side 304. The first axial side 302 may be offset from the second axial side in the upstream direction U. For example, the first axial side 302 may be upstream from the second axial side 304, relative to the centerline line C.

The cassette 102 may include a first adjoining end 306 and a second adjoining end 308. The cassette 102 may be circumferentially defined between the first adjoining end 306 and the second adjoining end 308. For example, the first adjoining end 306 may be circumferentially offset from the second adjoining end 308, with respect to the centerline C. In some examples, the cassette 102, or portions of the cassette 102, may include an accurate sheet that curves between the first adjoining end 306 and the second adjoining end 308. For example, the inner surface 118 of the cowl 104 may curve so that the cowl 104 may be received by an annular or semi-annular combustor dome that is annular with respect to the centerline C.

The cowl 104 may include a portion of the cassette 102 along the first axial side 302. The cowl 104 may extend from the first axial side 302 toward the second axial side 304. Alternately or addition, the cowl 104 may extend along the first axial side 302 of the cassette 102, from the first adjoining end 306 to the second adjoining end 308.

The cowl 104 may include a lip 310 along the first axial side 302 of the cassette 102. For example, the lip 310 may include a portion of the cassette 102 along the edge 115 of the cowl 104. The lip 310 may be positioned on the combustor dome 108 such that the lip 310 is upstream from the dome wall 113 (See FIG. 1 for an example of how cassettes may be oriented with the dome 108). The lip 310 may tapper toward the centerline C. Alternatively or in addition, the lip 310 may include a portion of the cassette 102 in which the outer surface 116 of the cassette 102 converges toward the inner surface 118 of the cassette 102. For example, a thickness of the lip 310 may vary with based on a distance from the edge 115 of the cowl 104. The thickness of the lip 310 may be a distance between the outer surface 116 and the inner surface 118 of the cassette 102. The thickness of the cowl 104 may vary with respect to the distance from the edge 115 such that the lip 310 is thinnest along the edge 115. The thickness of the lip 310 may increase as the distance from the edge 115 increases.

Depending on implementation, the thickness of the lip 310 may vary to improve a dynamic response of the cowl 104 during engine operation, a structural integrity of the cowl 104, and other design considerations. The lip 310 may be formed by way of ALM such that the lip is integral to the cowl 104. The tapering of the lip may include a curve that is formed layer by layer through ALM.

In some examples, a recess 312 may be defined in the cowl 104 along the first axial side of the cassette. The recess 312 may extend toward the second axial side of the cowl 104. Alternatively or in addition, the cowl 104 may include a collar 314 that defines the recess 312. The collar 314 may include a portion of the cassette 102 that extends radially away from or toward the centerline C. The collar 314 may include an outer surface 316 that intersects the outer surface 111 of the cassette 102. Alternatively or in addition, the cassette 102 may include a fillet 318 where the outer surface 111 of the cassette 102 and the outer surface of the collar 314 meet. For example, the fillet 318 may be a curved region along an intersection of the outer surface 111 of the cassette 102 and the outer surface 316 of the collar 314. The fillet 318 may be tapered thereby directing cooling fluid away from the outer surface 116 of the cassette 102 and/or around the recess 312. For example, the fillet 318 may be rounded along the intersection.

The collar 314 and/or the fillet 318 may be integral to the cassette and formed by way of ALM. For example, the collar 314 and/or the fillet 318 may be formed layer by layer via ALM. ALM may enable the fillet 318 and/or collar 314 to be tapered at various angles or curves. The fillet 318 and/or collar 314 may be integrated into the cowl 104, thereby removing the steps of fastening or joining separate components to the cowl 104. Alternatively or in addition, the recess 312 may be defined in layers successively added to the cassette 102 during formation, thereby eliminating additional steps of removing material to form the recess 312.

In some examples, the cowl 104 defines a fastener hole 309 or multiple fastener holes. The fastener hole 309 may receive a fastener for coupling the cowl 104 to the combustor dome 108. The fastener hole 309 may extend through the cassette 102, between an inner surface 118 and outer surface 116 of the cassette 102. The fastener hole 309 may receive a fastener to affix both the cowl 104 and the combustor wall 106 to the combustor dome 108. The fastener hole 309 may be defined by layers successively added to the cassette 102 during formation, thereby eliminating additional steps of removing material to form the fastener hole 309.

During assembly, the first adjoining end may be positioned along a second adjoining end of an adjacent cassette. The cassette 102 may include a groove 320 along the first adjoining end and/or the second adjoining end. For example, the groove may include a recess that extends toward the second adjoining end 308. In some examples, at least a portion of the cowl 104 and at least a portion of the combustor wall 105 may include the groove 320. The groove may be formed by successively creating layers by way of ALM. The layers may define the groove 320 thereby removing additional steps of removing material to form the groove 320 or coupling components together to define the groove 320.

Figure 4:
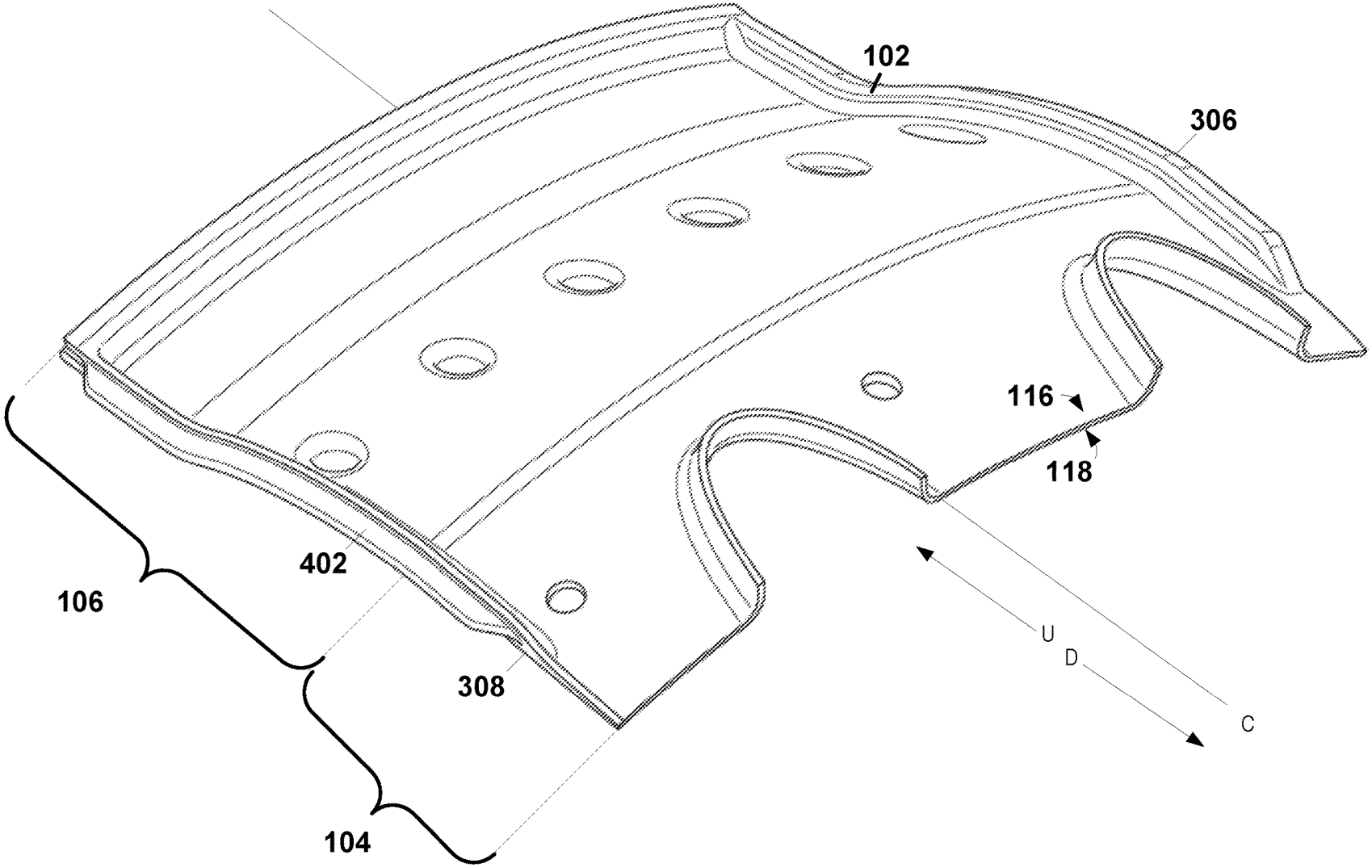
FIG. 4 illustrates a second perspective view of a cassette.

FIG. 4 illustrates a second perspective view of the cassette 102. The cassette 102 may include a tongue 402. The tongue 402 may be integral to the cassette 102. The tongue 402 may include a raised portion of the second end 308 of the cassette 102. The tongue 402 may be received by a groove of an adjacent cassette. In some examples, at least a portion of the cowl 104 and at least a portion of the combustor wall 106 may include the tongue 402. In some examples the cassette 102 may include multiple tongues and/or grooves. For example, the tongues of the cassette may be joined with the grooves of an adjacent cassette.

The tongue may be integrated into the cassette as a portion of the cassette. The tongue may be included in at least one layer solidified to form the cassette 102 by way of ALM. One or more layers may be added to the cassette 102 to define the tongue 402 on the cassette 102 with removing material from the cassette and/or without coupling components to the cassette to from the tongue 402.

In the example illustrated in FIGS. 3 and 4, the cassette 102 is oriented such the inner surface 118 may be received along an outer radius of an annular combustor dome arranged around the centerline C. In some examples, the cassette 102 may be oriented such that the outer surface 116 of the cassette 102 faces the centerline C so that the inner surface may be received along the inner radius of the annular combustor dome. In such examples, the cowl 104 and/or lip 310 of the cowl 104 may tapper away from the centerline C thereby causing air flowing along the outer surface 116 to radially flow away from the centerline C.

Figure 5:
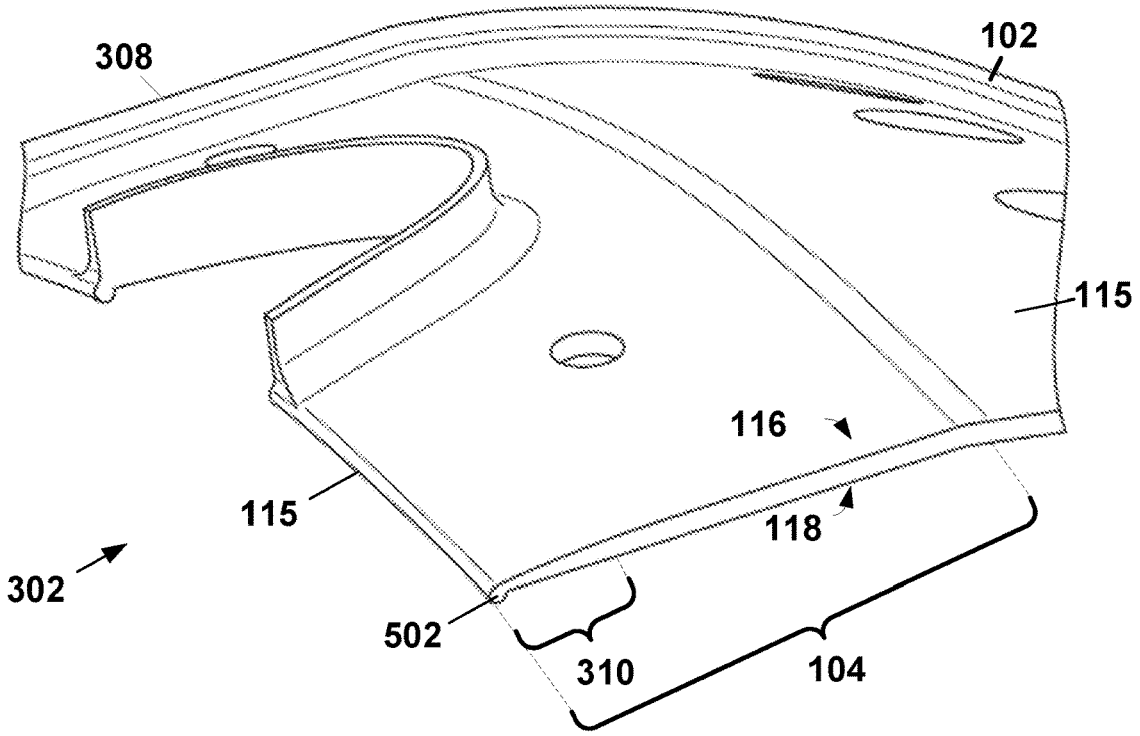
FIG. 5 illustrates a second example of a cassette.

FIG. 5 illustrates a second example of the cassette 102. The cassette 102 may include a rib 502 at the first axial side 302. The rib 502 may define the edge 115 of the cowl 104. The rib 502 may include a raised portion of the inner surface 118 of cassette 102. In some examples, the rib 502 may define an arcuate outer surface that joins the outer surface 116 of the cassette 102 with the inner surface 118 of the cassette. The rib 502 may extend between the adjoining ends 306, 308 of the cowl 104. Alternatively or in addition, the rib 502 may extend between the recess 312 and an end of the cowl 104. In other examples, the rib 502 may extend between recesses of the cowl 104. The rib 502, or similar type features, may add stiffness to the cowl. Alternatively or in addition, the rib 502, or similar features, may be arranged on the cowl to alter/tune the dynamic response of the cowl to prevent damaging vibration in the cowl during operation.

The rib 502 may be integral to the cassette 102. For example, the rib 502 may be integrated into the cassette 102 by way of ALM. For example, the rib 502 may be formed layer by layer via ALM. The rib 502 may be integrated into the cowl 104, thereby removing the steps of joining separate components to the cowl 104 and/or removing material from the cowl 104.

Figure 6:
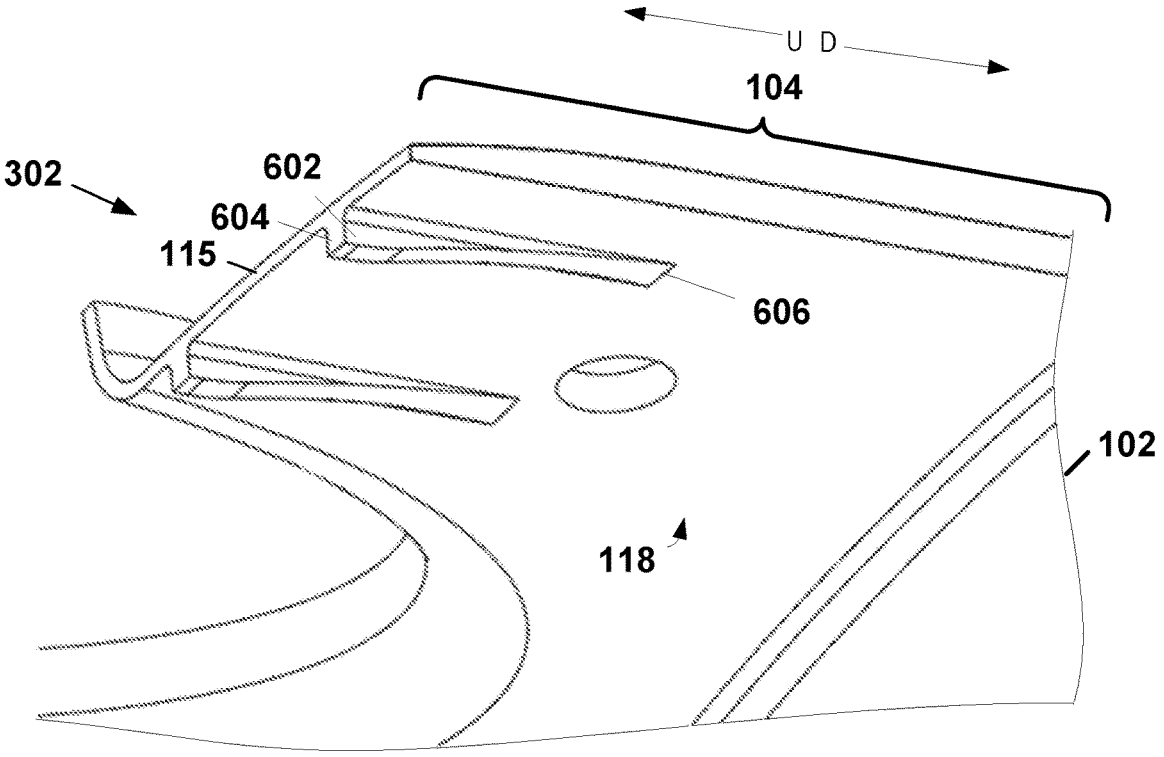
FIG. 6 illustrates a third example of the cassette.

FIG. 6 illustrates a third example of the cassette 102. In some examples, the cowl 104 may include a stiffener 602, or multiple stiffeners. The stiffener 602 may include a raised portion of the cassette 102 at extends away from the inner surface 118. Alternatively or in addition, the stiffener 602 may include a raised portion of the inner surface 118. The stiffener 602 may increase the structural integrity of the cowl. For example, the stiffener 602 may protect the cowl from damage caused by bird-strikes or other debris that may strike the cowl.

In some examples, the stiffener 602 may include an elongated rib. For example, a first end 604 of the stiffener 602 may be positioned at or proximate to the first side 302 of the cassette. The stiffener 602 may extend away from the edge 115 of the cowl 104. For example, stiffener 602 may extend along the upstream direction U and/or toward the second side of the cassette 102. A second end 606 of the stiffener 602 may be downstream from the first end 604 of the stiffener 602.

In some examples, the stiffener 602 may be tapered such that the first end 604 is further from the inner surface 118 of the cassette 102 than the second end 606. Alternatively or in addition, for example, the first end 604 may extend away from the inner surface 118 of the cassette 102 and the second end of the stiffener may be flush or approximately flush with the inner surface 118 of the cassette. Alternatively, the stiffener may curve from the first end 604 of the cassette 102 to the second end 606.

The stiffener 602 may be integral to the cassette 102. For example, the stiffener 602 may be integrated into the cassette 102 by way of ALM. The stiffener 602 may be formed layer by layer via ALM. The stiffener 602 may be integrated into the cowl 104 as a portion of the cowl 104, thereby removing the steps of joining separate components to the cowl 104 and/or removing material from the cowl 104 to define the stiffener 602.

The stiffener 602, or similar type features, may add stiffness to the cowl 104. Alternatively or in addition, the stiffener 602, or similar features, may be arranged on the cowl 104 to alter/tune the dynamic response of the cowl 104 to prevent damaging vibration in the engine during operation.

FIG. 7 illustrates a third example of the combustion system 100 a gas turbine engine 700. The cassette 102 may receive compressed air flowing from a diffusor 702. For example the cassette may split the air between an upstream direction U and a downstream direction D. The cowl 104 may guide the air along the upstream direction U. Alternately or in addition, the cowl 104 may be tapered such that the air is guided by the cowl 104 along a radially inward direction I. The air may be guided radially inward from the edge of the cowl. The air may flow back along the downstream direction D and into the combustion chamber 112 via one or more inlets 110.

In some examples, the collar 314 may divert the compressed air around the fuel injector assembly 704. For example, the recess of the cowl 104 may receive a stem 706 of the fuel injector assembly 704. The collar 314 may cause air to flow around stem of the fuel injector assembly and over the edge 115.

The opposing cassette 124 may be positioned radially inward from the cassette 102. The opposing cowl 126 may receive air from the diffusor and guide the air in a radial inward direction I. For example, opposing cowl 126 may tapper toward the cowl 104. Alternatively or in addition, the cowl 104 may tapper toward the opposing cowl 126. The combustion chamber 112 may be defined between the cassette 102 and the opposing cassette 124.

Figure 8:
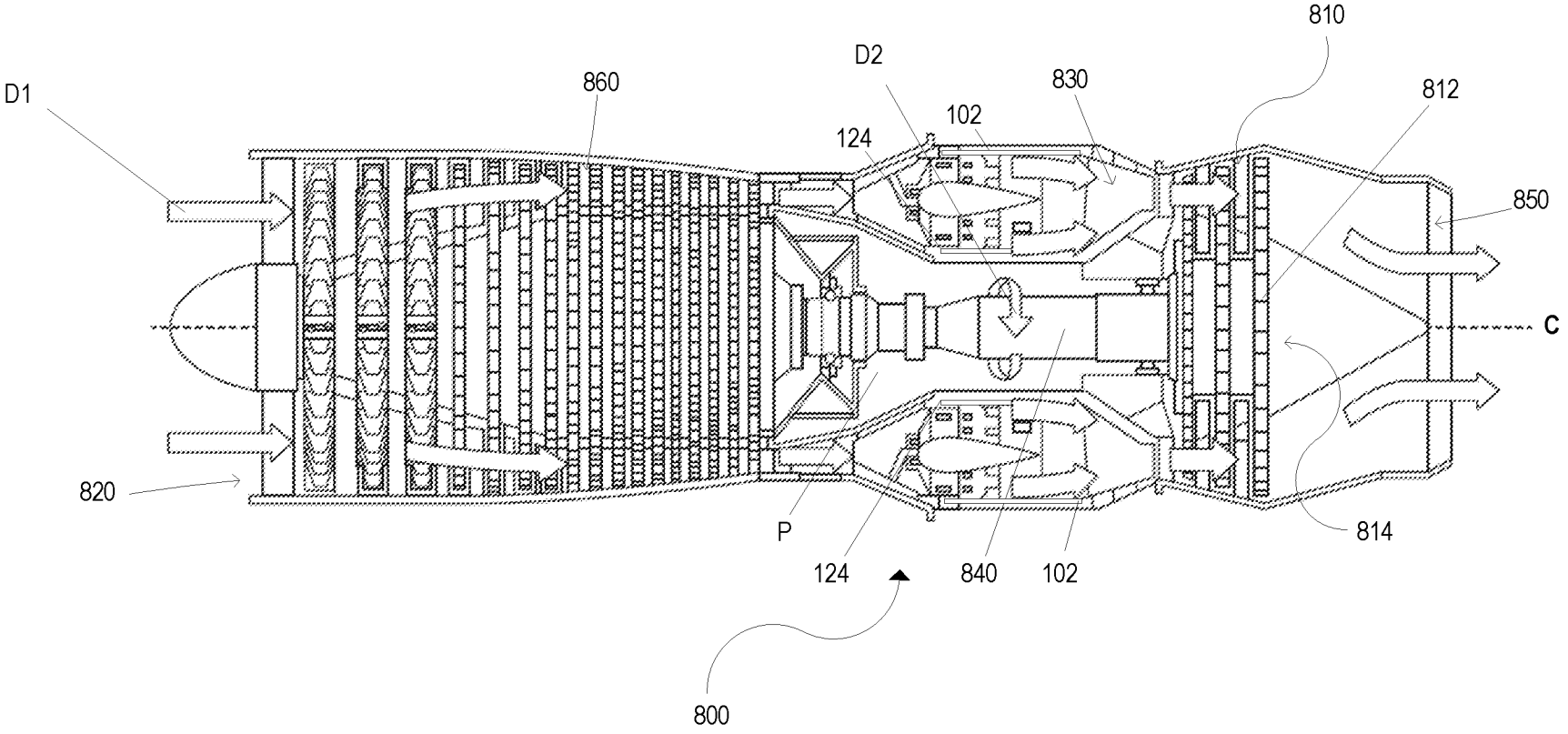
FIG. 8 illustrates a cross-sectional view of a gas turbine engine.

FIG. 8 illustrates a cross-sectional view of a gas turbine engine 800. In some examples, the gas turbine engine 800 may supply power to and/or provide propulsion of an aircraft. Examples of the aircraft may include a helicopter, an airplane, an unmanned space vehicle, a fixed wing vehicle, a variable wing vehicle, a rotary wing vehicle, an unmanned combat aerial vehicle, a tailless aircraft, a hover craft, and any other airborne vehicle. Alternatively or in addition, the gas turbine engine 800 may be utilized in a configuration unrelated to an aircraft such as, for example, an industrial application, an energy application, a power plant, a pumping set, a marine application (for example, for naval propulsion), a weapon system, a security system, a perimeter defense or security system.

The gas turbine engine 800 may take a variety of forms in various embodiments. Though depicted as an axial flow engine, in some forms the gas turbine engine 800 may have multiple spools and/or may be a centrifugal or mixed centrifugal/axial flow engine. In some forms, the gas turbine engine 800 may be a turboprop, a turbofan, or a turboshaft engine. Furthermore, the gas turbine engine 800 may be an adaptive cycle and/or variable cycle engine. Other variations are also contemplated.

The gas turbine engine 800 may include an intake section 820, a compressor section 860, a combustion section 830, a turbine section 810, and an exhaust section 850. During operation of the gas turbine engine 800, fluid received from the intake section 820, such as air, travels along the direction D1 and may be compressed within the compressor section 860. The compressed fluid may then be mixed with fuel and the mixture may be burned in the combustion section 830. The combustion section 830 may include any suitable fuel injection and combustion mechanisms. The combustion section 830 may include the cowl 104 and/or the opposing cowl 126. For example, the cowl 104 may influence the pressure of the air around the fuel injection and combustion mechanisms. The hot, high pressure fluid may then pass through the turbine section 880 to extract energy from the fluid and cause a turbine shaft of a turbine 814 in the turbine section 810 to rotate, which in turn drives the compressor section 860. Discharge fluid may exit the exhaust section 850.

As noted above, the hot, high pressure fluid passes through the turbine section 810 during operation of the gas turbine engine 800. As the fluid flows through the turbine section 810, the fluid passes between adjacent blades 812 of the turbine 814 causing the turbine 814 to rotate. The rotating turbine 814 may turn a shaft 840 in a rotational direction D2, for example. The blades 812 may rotate around an axis of rotation, which may correspond to a centerline C of the turbine 814 in some examples.

Figure 9:
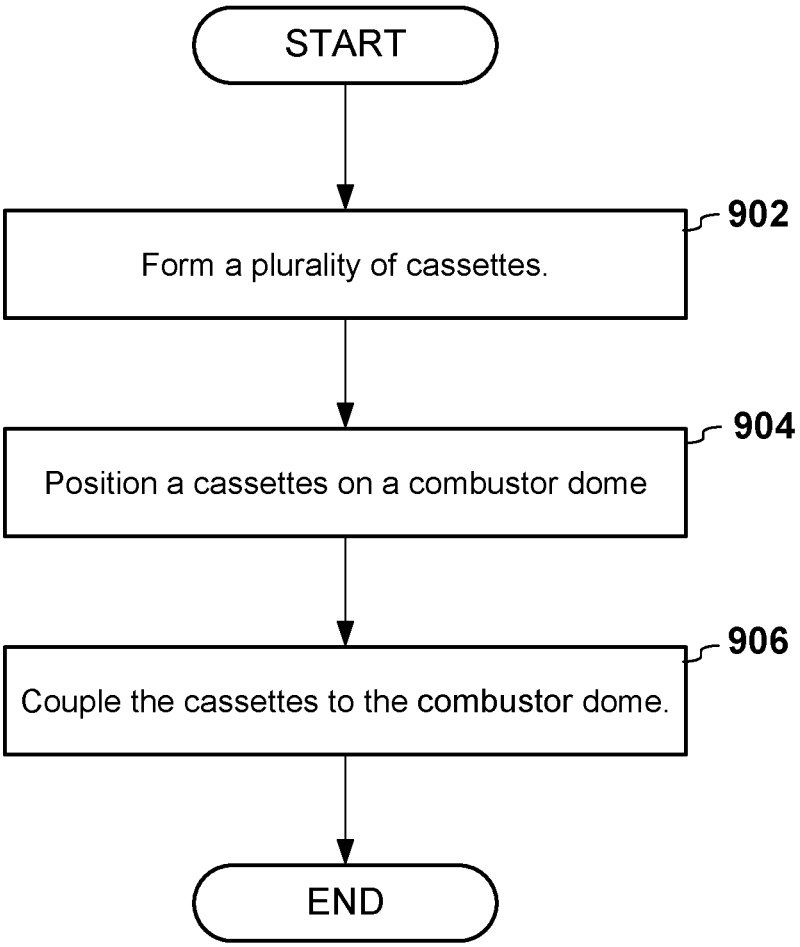
FIG. 9 illustrates a flow logic for manufacturing a combustor system.

FIG. 9 illustrates a flow logic for manufacturing the combustor system 100. Manufacturing the combustor system 100 may include forming the cassettes 202. The steps may include additional, different, or fewer operations than illustrated in FIG. 9. The steps may be executed in a different order than illustrated in FIG. 9.

For example, ALM may form the cassettes 202. The cassettes 202 may be formed by applying a laser to a powder bed to define successive layers fused together by the laser. Each of the layers comprises various portions of the cassette 102 and/or the opposing cassette 124. For example, at least one of the layers of the cassette 102 may include a portion of the cowl 104 and a portion of the combustor wall 106. Alternately or in addition, at least one of the layers may include at least one of the cowl lip 310, the collar 314, the tongue 402 the rib 502, and/or the stiffener 602. In some examples, the layer formed by fusing the power may define, or partially define, the recess 312, the groove 320, and/or the fastener hole 309. In other examples, other methods of additive layer manufacturing may be employed to form the cassette 102 and/or the opposing cassette.

Manufacturing the combustor system 100 may further include positioning the cassette 102 on the combustor dome 108 (904). The cassette 102 may be positioned such that the combustor wall 106 of the cassette 102 at least partially defines the combustion chamber 112. For example, the inner surface 118 of the cassette 102 may be positioned on the first outer surface 120 of the combustor dome 108. The combustor wall 106 may be positioned downstream from the dome wall 113. At least a portion of the cowl 104 may extend away from the dome wall 113 and the combustion chamber 112.

Manufacturing the combustor system 100 may further include coupling the cassette 102 to the combustor dome 108. For example, a fastener may couple the cassette 102 to the combustor dome 108. Multiple cassettes may be positioned on the combustor dome 108 and fastened to the combustor dome 108. In other examples, the cassettes may be braised or welded to the combustor dome 108.

To clarify the use of and to hereby provide notice to the public, the phrases "at least one of <A>, <B>, . . . and <N>" or "at least one of <A>, . . . <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

1. A system comprising:

a cassette configured to couple to an annular combustor dome arranged around a flow path for a gas turbine engine, the annular combustor dome comprising a dome wall comprising a plurality of inlets configured to receive compressed air for a combustion chamber located downstream, relative to the flow path, from the annular combustor dome the cassette comprising:

a combustor wall extended away from the dome wall in a downstream direction, relative to the flow path, and defines at least a portion of the combustion chamber; and a cowl integral to the combustor wall, wherein at least a portion of the cowl extends away from the dome wall in an upstream direction relative to the flow path, wherein the cowl is configured to receive the compressed air from a diffusor and guide the compressed air to a space upstream from the inlets, relative to the flow path.

2. The system of aspect 1, wherein the cassette comprises a plurality of layers fused together based on powder bed fusion, wherein each of the layers comprises a portion of the cowl and the combustor wall.

3. The system of any of aspects 1 to 2, wherein the cowl is coupled to the combustor dome and the combustor wall along the downstream direction and away from the combustor dome.

4. The system of any of aspects 1 to 3, wherein the cowl comprises a cowl lip integral to the cowl, wherein the cowl lip is tapered toward the space to guide the compressed air toward the space.

5. The system of any of aspects 1 to 4, wherein the cassette is defined between a first axial side and a second axial side, the first axial side is upstream from the second axial side, wherein the cowl further comprises a collar, wherein the collar defines a recess in the cowl along the first axial side, wherein the recess extends in the downstream direction and collar extends in a radially outward direction and away from an outer surface of the cassette.

6. The system of aspect 5, wherein the cassette is further defines a hole configured to receive a fastener to couple the combustor wall and the cowl to the combustor dome.

7. The system of any of aspects 1 to 5, wherein the cassette includes first axial side and a second axial side, wherein the first axial side is upstream from the second axial side, wherein the cowl comprises a plurality of stiffening ribs integral to the cowl, each of the stiffening ribs spaced along the first axial side of the cassette, wherein each of the stiffening ribs extend toward the second axial side.

8. A combustor for a gas turbine engine, the combustor comprising:

an annular combustor dome arranged around a flow path for the gas turbine engine, the annular combustor dome comprising a first outer surface and a second outer surface radially inward from the first outer surface, relative to the flow path, the annular combustor dome comprising a dome wall defined between the first outer surface and a second outer surface, the dome wall including a plurality of inlets in fluid communication with a combustion chamber downstream from the combustor dome, relative to the flow path; and a plurality of cassettes joined together and positioned on the first outer surface of the dome, at least one of the cassettes including a cowl integral to a combustor wall, wherein the combustor wall extends along a downstream direction, relative to the flow path, and at least partially defines the combustion chamber, wherein the cowl extends away from the combustor dome in an upstream direction, relative to the flow path, and is configured to convey air received from a diffusor in a radial inward direction to a space upstream of the combustor dome.

9. The combustor of aspect 8, wherein each of the cassettes comprises a plurality of layers successively fused together by an energy beam, wherein each of the layers comprise a portion of the cowl and the combustor wall.

10. The combustor of any of aspects 8 to 9, wherein the dome wall at least partially defines the combustion chamber, wherein combustor wall extends away from the dome wall.

11. The combustor of any of aspects 8 to 10, the cowl comprises a stiffener integral to the cowl, the stiffener comprising a raised portion of the cowl extended along a surface of the cowl away from an edge of the cowl.

12. The combustor of any of aspects 8 to 11, further comprising:

a plurality of opposing cassettes joined together and positioned on the second outer surface of the dome, the plurality of opposing cassettes positioned radially inward from the first plurality of cassettes, relative to the flow path, at least one of the opposing cassettes including an opposing cowl integral to an opposing combustor wall, wherein the opposing combustor wall extends in the downstream direction and the combustion chamber is at least partially defined between the opposing combustor wall and the combustor wall, wherein the opposing cowl extends away from the combustor dome in the upstream direction.

13. The combustor of any of aspects 8 to 12, wherein the cassettes comprises a first cassette and a second cassette, the first cassette adjacent to the second cassette on the combustor dome, wherein the first cassette comprises a tongue positioned in a groove defined by an adjoining edge of the second cassette.

14. The combustor of aspect 13, wherein the cassette comprises a first axial side and a second axial side, the cowl further comprising a collar and a lip, the collar and the lip being integral to the cowl, wherein the collar defines a recess along the first axial side and the lip comprises a portion of the cowl along an edge of the cowl and adjacent to the recess, wherein the collar extends along a radial inward direction, and the lip extends along a radial outward direction, wherein the collar is configured to divert air around a fuel injector assembly positioned at least partially in the recess and the lip is configured to guide air toward a space upstream from the dome wall and radially inward from the cowl.

15. A method comprising forming, by additive layer manufacturing, a plurality of cassettes for a gas turbine engine, each of the cassettes comprising a cowl integral to a combustor wall;

positioning at least one of the cassettes on an outer surface of an annular combustor dome so that the combustor wall at least partially defines a combustion chamber downstream from the dome and at least a portion of the cowl is positioned upstream from the combustor dome, relative to a flow path that extends through a cross section of the combustor dome; and coupling the at least one of the cassettes to the annular dome.

16. The method of aspect 15, wherein the step of positioning further comprises:

joining a groove in a first cassette with a tongue of a second cassette.

17. The method of any of aspects 15 to 16, further comprising:

forming, by additive layer manufacturing, a plurality of opposing cassettes, each of the opposing cassettes comprising an opposing cowl integral to an opposing combustor wall; and positioning at least one of the opposing cassette on a second outer surface of the annular combustor dome so that and at least a portion of the opposing cowl is positioned opposite the cowl, and the combustion chamber is defined between the opposing combustor wall and the combustor wall.

18. The method of any of aspects 15 to 17, wherein the step of forming the plurality of cassettes further comprises:

applying metallic powder to a previously solidified layer of the cassette; and directing an energy beam to the metallic powder to solidify the power and generate a new layer of the cassette, the new layer comprising at least a portion of the cowl and at least a portion of the outer combustor wall.

19. The method of aspect 18, wherein the new layer further comprises a rib configured to be positioned along an edge of the cowl.

20. The method of aspect 18, wherein the new layer further comprises at least a portion of a collar configured to define a recess along an edge of the cowl.

What is claimed is:

1. A system comprising:

a cassette configured to couple to an annular combustor dome arranged around a flow path for a gas turbine engine, the annular combustor dome comprising a dome wall comprising a plurality of inlets configured to receive compressed air for a combustion chamber located downstream, relative to the flow path, from the annular combustor dome, the cassette comprising:

a plurality of layers fused together in an additive manufacturing process to form a cowl integral with a combustor wall;

the combustor wall integral to the cowl, spaced away from the dome wall, and extending in a downstream direction, relative to the flow path, to define at least a portion of the combustion chamber; and the cowl integral to the combustor wall and coupled to the dome wall to maintain the combustor wall spaced away from the dome wall, wherein at least a portion of the cowl extends away from the dome wall in an upstream direction relative to the flow path to an axially forwardmost peripheral edge of the cowl, the axially forwardmost peripheral edge positioned radially outward and upstream, relative to the flow path, from the inlets, wherein the cowl is configured to receive the compressed air from a diffusor and guide the compressed air past the axially forwardmost peripheral edge to a space upstream from the inlets, relative to the flow path.

2. The system of claim 1, wherein the plurality of layers are fused together based on powder bed fusion.

3. The system of claim 1, wherein the axially forwardmost peripheral edge of the cowl comprises a cowl lip integral to the cowl, wherein the cowl lip is tapered toward the space to guide the compressed air toward the space.

4. The system of claim 1, wherein at least one of the plurality of layers comprise a metallic powder.

5. The system of claim 1, wherein the cassette is defined between a first axial side and a second axial side, the first axial side is upstream from the second axial side, wherein the cowl further comprises a collar, wherein the collar defines a recess in the cowl along the first axial side, wherein the recess extends in the downstream direction and the collar extends in a radially outward direction and away from an outer surface of the cassette.

6. The system of claim 5, wherein the cowl further defines a hole configured to receive a fastener to couple the cowl to the combustor dome.

7. The system of claim 1, wherein the cassette includes opposing first and second surfaces extending between a first axial side and a second axial side, wherein the first axial side is upstream from the second axial side, wherein the cowl comprises a plurality of stiffeners integral to the cowl and formed by the layers, each of the stiffeners being a raised portion extending away from the first surface opposite a planar surface portion of the second surface, the stiffeners spaced along the first axial side of the cassette, wherein each of the stiffeners extend toward the second axial side.

8. The system of claim 7, wherein the raised portion of the stiffeners are elongated ribs having a first end and a second end, wherein the elongated ribs are tapered such that first end extends away from the first surface further than the second end.

9. A combustor for a gas turbine engine, the combustor comprising:

an annular combustor dome arranged around a flow path for the gas turbine engine, the annular combustor dome comprising a first outer surface and a second outer surface, the second outer surface positioned radially inward from the first outer surface, relative to the flow path, the annular combustor dome comprising a dome wall defined between the first outer surface and the second outer surface, the dome wall including a plurality of inlets in fluid communication with a combustion chamber downstream from the combustor dome, relative to the flow path; and a plurality of cassettes joined together and positioned on the first outer surface of the combustor dome, wherein each of the cassettes comprises a plurality of layers successively fused together by additive layer manufacturing to form, with the layers, a cowl integral to a combustor wall, wherein the cowl is coupled with the dome wall, and the combustor wall is spaced away from the dome wall by the cowl to extend along a downstream direction, relative to the flow path, and at least partially define the combustion chamber, wherein the cowl extends away from the combustor dome in an upstream direction, relative to the flow path, to an axially forwardmost peripheral edge of the cowl positioned radially outward from the dome wall, and wherein the cowl is configured to convey air received from a diffusor over the axially forwardmost peripheral edge in a radial inward direction to a space upstream of the combustor dome.

10. The combustor of claim 9, wherein the plurality of layers are successively fused together by an energy beam to create both a portion of the cowl and a portion of the combustor wall.

11. The combustor of claim 9, wherein the dome wall at least partially defines the combustion chamber, wherein the combustor wall extends away from the dome wall.

12. The combustor of claim 9, wherein the cowl comprises a first surface and an opposing second surface, and a stiffener integral to the cowl, the stiffener comprising a raised portion of the cowl extended along the first surface of the cowl away from an edge of the cowl and opposite a planar surface on the opposing second surface of the cowl.

13. The combustor of claim 9, further comprising:

a plurality of opposing cassettes joined together and positioned on the second outer surface of the combustor dome, the plurality of opposing cassettes positioned radially inward from the plurality of cassettes, relative to the flow path, at least one of the opposing cassettes being a plurality of layers successively fused together by additive layer manufacturing to form, with the layers, an opposing cowl integral to an opposing combustor wall, wherein the opposing combustor wall is spaced away from the combustor dome to extend in the downstream direction such that the combustion chamber is at least partially defined between the opposing combustor wall and the combustor wall, wherein the opposing cowl is coupled with the combustor dome and extends away from the combustor dome in the upstream direction.

14. The combustor of claim 13, wherein the opposing cowl is positioned opposite the cowl.

15. The combustor of claim 9, wherein the cassettes comprises a first cassette and a second cassette, the first cassette adjacent to the second cassette on the combustor dome, wherein the first cassette comprises a tongue positioned in a groove defined by an adjoining edge of the second cassette.

16. The combustor of claim 15, wherein each of the first cassette and the second cassette comprises a first axial side and a second axial side, the cowl further comprising a collar and a lip, the collar and the lip being integral to the cowl, wherein the collar defines a recess along the first axial side and the lip comprises a portion of the cowl along the axially forwardmost peripheral edge of the cowl and adjacent to the recess, wherein the collar extends along a radial inward direction, and the lip extends along a radial outward direction, wherein the collar is configured to divert the air around a fuel injector assembly positioned at least partially in the recess and the lip is configured to guide the air toward the space upstream from the dome wall and radially inward from the cowl.

17. A system comprising:

a cassette comprising a plurality of layers formed by additive manufacturing, the plurality of layers coupled to an annular combustor dome arranged around a flow path for a gas turbine engine, the annular combustor dome comprising a dome wall comprising a plurality of inlets configured to receive compressed air for a combustion chamber located downstream, relative to the flow path, from the annular combustor dome; and the plurality of layers forming a combustor wall extending in a downstream direction, relative to the flow path, to define at least a portion of the combustion chamber, and the plurality of layers also forming a cowl extending away from the dome wall in an upstream direction relative to the flow path to an axially forwardmost peripheral edge of the cowl that is positioned radially outward and upstream, relative to the flow path, from the inlets, wherein one of the cowl or the combustor wall is coupled with the dome wall such that the other of the cowl or the combustor wall is spaced away from the dome wall, and the cowl is configured to receive the compressed air from a diffusor and guide the compressed air to a space upstream from the inlets, relative to the flow path, and wherein the combustor wall and the cowl are integrally formed as a continuous unitary structure by the plurality of layers.

18. The system of claim 17, wherein the combustor wall defines at least one fastener hole to receive a fastener to affix the combustor wall to the annular combustor dome, such that the cowl is spaced away from the combustor dome.

19. The system of claim 17, wherein the cowl comprises a first surface and a second surface, the first surface opposite the second surface such that an integrally formed raised portion on the first surface is opposite a planar surface of the second surface, the raised portion being an elongated rib having a first end closer to the axially forwardmost peripheral edge than a second end, and the second end being closer than the first end to the combustor wall, wherein the elongated rib is tapered such that first end extends away from the first surface further than the second end.

* * * * *